United States Patent [19]

Hochholzer

[11] Patent Number: 4,866,413

[45] Date of Patent: Sep. 12, 1989

[54] POTENTIOMETER AND METHOD OF MAKING THE SAME

[75] Inventor: Reinhard Hochholzer, Höhenkirchen, Fed. Rep. of Germany

[73] Assignee: Wilhelm Ruf KG, Munich, Fed. Rep. of Germany

[21] Appl. No.: 244,298

[22] Filed: Sep. 15, 1988

[30] Foreign Application Priority Data

Sep. 17, 1987 [DE] Fed. Rep. of Germany ..... 3731328

[51] Int. Cl.[4] ..... H01C 10/34; H01C 10/16

[52] U.S. Cl. ..... 338/174; 338/132; 338/130

[58] Field of Search ..... 338/164, 184, 174, 237, 338/254, 255, 256, 128, 130, 131, 132, 134; 29/610.1

[56] References Cited

U.S. PATENT DOCUMENTS

| | | | |
|---|---|---|---|
| 3,230,491 | 1/1966 | Dreyfus et al. | 338/134 X |
| 3,671,914 | 6/1972 | Wormser | 338/131 |
| 3,697,921 | 10/1972 | Urwin | 338/131 |
| 3,859,618 | 1/1975 | Nishioka et al. | 338/130 X |
| 3,918,022 | 11/1975 | Puerner | 338/134 |
| 3,953,821 | 4/1976 | Kelver et al. | 338/174 |
| 4,035,758 | 7/1977 | Panke | 338/132 |
| 4,109,230 | 8/1978 | Frey, Jr. | 338/164 |
| 4,114,445 | 9/1978 | Nelson | 338/131 X |

FOREIGN PATENT DOCUMENTS

| | | |
|---|---|---|
| 2709998 | 9/1978 | Fed. Rep. of Germany . |
| 3714348 | 11/1988 | Fed. Rep. of Germany . |
| 3717117 | 12/1988 | Fed. Rep. of Germany . |
| 3717306 | 12/1988 | Fed. Rep. of Germany . |

*Primary Examiner*—E. A. Goldberg
*Assistant Examiner*—M. Lateef
*Attorney, Agent, or Firm*—Cushman, Darby & Cushman

[57] ABSTRACT

The potentiometer consists of two halves. Each half has a base plate (5,6) ending in soldering lugs (51,61,62). One part each of a casing (1 or 2) and a rotary driver half (3 or 4, respectively) are molded to each base plate in a plastics injection molding process. The two potentiometer halves are interconnected at their casing parts (1,2), on the one hand, and at their rotary driver halves (3,4), on the other hand, by ultrasonic welding. For this purpose a circumferential thickening (15,47) each is provided of tapering shape. A slider spring (8) on the one hand has slider lobes (81) which slide on a resistor path of a resistor plate (7) and, on the other hand, slider lobes (80) which slide on the base plate (5) opposite the resistor plate (7). Hereby the central or potentiometer tapping is effected electrically at this base plate (5) and the soldering lug (51) connected to the same.

10 Claims, 3 Drawing Sheets

POTENTIOMETER AND METHOD OF MAKING THE SAME

FIELD OF THE INVENTION

The instant invention relates to a potentiometer, comprising a casing, a cover for the casing, a resistor plate, a rotary driver, and a slider spring non-rotatably fixed to said driver and in sliding contact with a resistor path formed on the resistor plate, the casing, the cover, and the rotary driver being made of plastics.

BACKGROUND OF THE INVENTION

Potentiometers of this kind are known in general in the art, especially so in the form of rotary potentiometers.

In general, it is difficult with potentiometers to seal the interior of the potentiometer hermetically to the outside, i.e. especially the resistor path and the slider spring. DE-PS No. 27 09 998 suggests that the actuating shaft of a trimming potentiometer be sealed by a shaft collar, on the one hand, and a chamber in the casing receiving the collar, on the other hand, being filled with grease, while the casing and the cover of the casing are sealed by a casting compound. This is expensive to produce. Moreover, the sealing function of a "grease packing" is limited in time as the grease resinifies and also oozes out of its chamber if the potentiometer is used frequently.

It is likewise generally known (cf. the earlier German patent application No. P 37 14 348.4) to seal the casing and the cover, on the one hand, and the actuating shaft and the rotary driver, on the other hand, by rubber rings. That is disadvantageous, too, because such rubber rings not only are quite expensive but also involve greater expenditure in assembly and the rubber rings have a limited service life as the rubber becomes brittle.

It is known from the applicant's earlier German patent application No. P 37 17 117.8 of May 21, 1987 to mold the slider of a linear potentiometer integrally with a guide member by injection molding, the guide member presenting part of the injection mold. This injection molding technique was applied in that case so as to obtain reproducible sliding forces between the slider and the guide member, regardless of manufacturing tolerances of the guide member.

Finally, it is known from the applicant's earlier German patent application No. P 37 17 306.5 of May 22, 1987 to apply a plastics injection molding process for making both a circuit board and a soldering lug for obtaining the contacting of circuit board conductors, the two elements mentioned being pressed against each other by rams during the casting process. The contact pressure required was exerted by the plastic material itself upon curing as the material shrinks when solidifying.

SUMMARY OF THE INVENTION

It is an object of the instant invention to improve the potentiometer of the type specified initially such that it can be produced very inexpensively and almost totally automatically. It is another object of the invention to provide a potentiometer of the type in question which has a hermetically sealed interior and thus is specifically liquid-tight.

The one hundred percent tight sealing of the interior of the potentiometer is important not only during the future operation in an agressive or humid atmosphere.

With the widely mechanized assembly procedure employed nowadays also the rosin used during soldering must be washed off and that is accomplished with freon, for instance.

The above mentioned objects are met, in accordance with the invention, in a potentiometer of the type specified in that the rotary driver is made of two rotary driver halves, the one rotary driver half together with the cover are formed integrally with a base plate and/or the resistor plate by a plastics injection molding process, the other rotary driver half together with the casing are formed integrally with another (base) plate by a plastics injection molding process, and the two rotary driver halves, on the one hand, and the casing together with the cover, on the other hand, each are welded together. Advantageous modifications and further developments of the invention may be gathered from the subclaims. Claim 10 presents a method of manufacturing a band by which the potentiometer according to the invention can be produced in a multiple use process almost entirely automatically.

The integral molding of the plastics members (casing halves and rotary driver halves) on the one hand provides excellent sealing and, on the other hand, even more accurately reproducible torques for the rotational actuation of the rotary driver, the sealing function and the torque being obtained independently of dimensional tolerances of the basic body and/or the injection mold. The perfect sealing between the two casing portions on the one hand and the two rotary driver halves, on the other hand, is achieved by ultrasonic welding. The features recited in claim 2 provide a surprising slider or center tap structure of the potentiometer in that the slider spring slides on two opposed planes. For this reason the center tap need not be aligned with the axis of rotation of the potentiometer, as is customary with conventional potentiometers. It is likewise possible hereby to provide the potentiometer with a central through-hole for an actuating shaft and still seal the interior hermetically tight.

The features as recited in claims 3 and 4 afford the opportunity of good ultrasonic welding to join the respective members as the ultrasound energy concentrates in the tips of the respective thickenings.

Claim 5 permits an increase of the torque which can be transmitted from one rotary driver half to the other.

Good contacting between the lateral taps of the potentiometer and the associated soldering lugs is obtained by the measures of claim 6.

The sealing is enhanced by the feature of claim 7 as practically no gap is formed into which liquid might enter since the mutual welding is effected as closely as possible to the edge of the through-hole.

Uniform injection molding of the respective plastics members under identical conditions is achieved by claim 8 as well as precise alignment of the rotary driver halves for the subsequent assembly operation.

It is an advantage of the feature of claim 9 that separate soldering lugs are no longer needed as they have become an integral component of the base plates.

Claim 10, finally, recites the method of producing the potentiometer. It can be carried out fully automatically, yielding potentiometers of uniform quality and, in addition, permitting band manufacture in multiple process operation.

BRIEF DESCRIPTION OF THE DRAWING

The invention will be described further, by way of example, with reference to the accompanying drawings, in which.

DESCRIPTION OF THE PREFERRED EMBODIMENT

Figure 1:
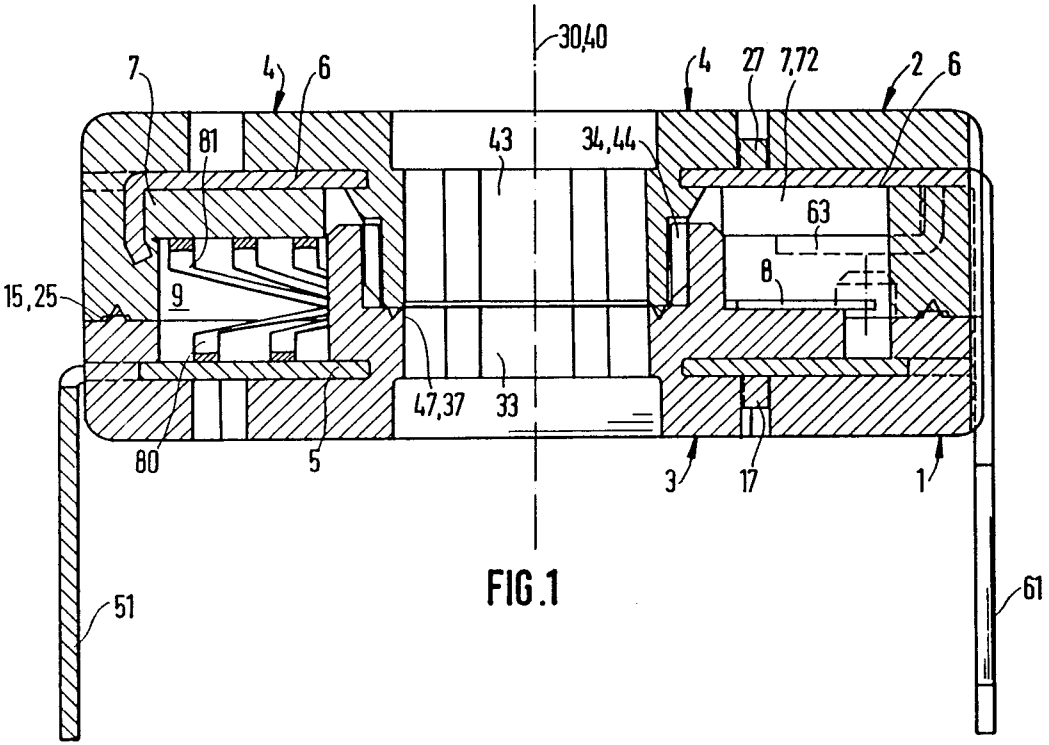
FIG. 1 is a cross sectional view of the potentiometer.

Identical parts are designated by the same reference numerals in the various figures.

The potentiometer consists of two assembly groups, namely a "lower" assembly group and a cover assembly group. The lower assembly group in turn consists of a lower casing portion 1 and a lower rotary driver half 3, a lower base plate 5 and a slider spring 8. The cover assembly group consists of a cover portion 2 for the casing, a base plate 6, and a resistor plate 7. The two assembly groups are welded together in such manner that an interior 9 housing the slider spring 8 and the resistor plate 7 is hermetically sealed toward the outside so that neither moisture nor any liquid can penetrate into the interior.

The casing portions 1 and 2 and the rotary driver halves 3 and 4 each are made of a plastic material which is suitable for injection molding. It is molded partially around the associated base plate 5, 6 so that perfect sealing is obtained between casing portions 1 and 2 and the respective base plate 5 or 6, with soldering lugs 51, 61, and 62 extending away from the same out of the casing. On the other hand, perfect sealing is obtained also between the rotary driver halves 3 and 4 and their associated base plates 5 and 6, respectively, and a well defined torque is obtained for rotating the two rotary driver halves with respect to the base plates.

The two assembly groups are welded together by ultrasonic energy. The ultrasonic energy is directed to the desired locations by thickenings 15 and 47, respectively, of triangular cross section formed at the one housing portion 1 and at the one rotary driver half 4 and oriented toward the respective opposed member. These thickenings absorb the ultrasonic energy so that the plastic material is welded at those locations. The cover portion 2 for the casing and the lower rotary driver half are formed with planar surfaces 25 and 37, respectively, opposite the circumferential thickenings 15 and 47, respectively. The planar surface 25 of the cover portion 2 is formed as a groove having a flat bottom and, upon welding, this groove is filled substantially completely by the material of the thickening 15.

In the embodiment shown, both base plates 5 and 6 are made of electrically conductive material, such as bronze. Of course, other materials may be used as well, such as plates provided with an electrically conductive coating. The upper side of the base plate 5 facing into the interior 9 serves as a slider path on which the slider spring 8 slides along by spring lobes 80. As the base plate 5 terminates by a soldering lug 51 which projects out of the housing, this provides the center tap of the potentiometer. The slider spring 8 furthermore includes spring lobes 81 which slide on the resistor path of the resistor plate 7 facing the interior 9. As the spring lobes 81 are connected electrically with the spring lobes 80 through the slider spring 8, the soldering lug 51 is connected electrically through two slider systems (80, 81) with the slider tap of the resistor path of the resistor plate 7.

The two lateral taps of the resistor plate 7 are formed by contact tabs 63 and 64 formed by punching and bending of the material of the base plate 6 and touching the respective ends of the resistor path. As these contact tabs 63 and 64 likewise are cast in the plastic material of the casing portion 2 and the plastic shrinks somewhat as it solidifies, sufficient contact pressure or force is developed between the respective contact tab 63 or 64 and the respective end of the resistor layer 70.

Portions of both rotary driver halves are mutually engaged by teeth (internal toothing 34 and external toothing 44) in order to provide a perfect rotary coupling between the two rotary driver halves 3 and 4 rather than having to rely only on the "welding seam" (37, 47) between the two rotary driver halves.

The plastics members 1 and 3, on the one hand, and 2 and 4, on the other hand, each are cast completely in a mold and, therefore, are shown by the same hatching in the drawings. Such casting is rendered possible by sprues 17 and 27 provided between casing portion 1 and rotary driver half 3, on the one hand, and between casing portion 2 and rotary driver half 4, on the other hand. These sprues are removed later on so as to permit rotation of the rotary driver halves with respect to the casing portions.

Figure 2:
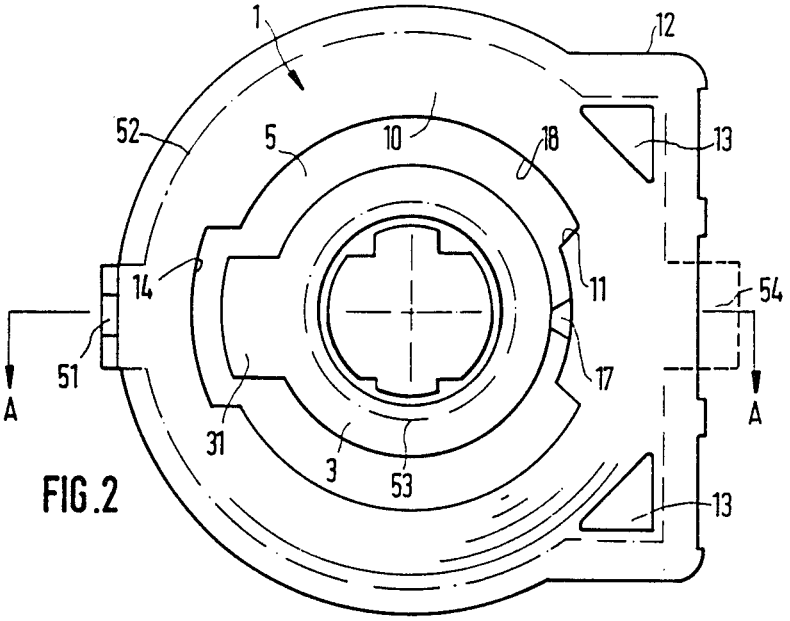
FIG. 2 is a view of the lower outer side of the bottom half of the potentiometer.
Figure 3:
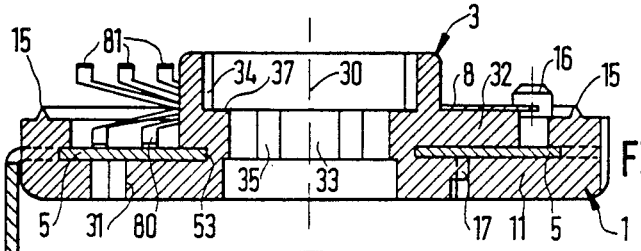
FIG. 3 is a sectional view along line A—A in FIG. 2, in other words of the lower half of the potentiometer.
Figure 4:
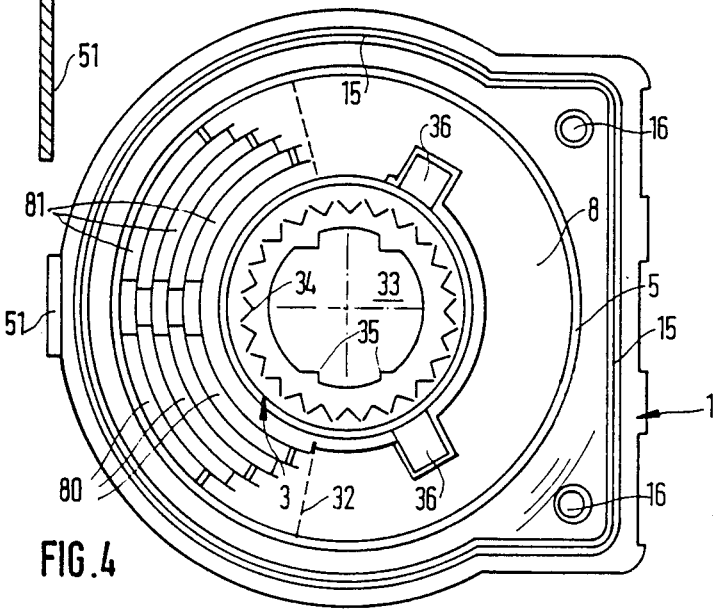
FIG. 4 is a top plan view of the upper inner side of the bottom half of the potentiometer.

Reference will now be made to FIGS. 2 to 4. In the top plan view of FIG. 2 the base plate 5 substantially has the form of an annular disk. Its outer edge is indicated by a discontinuous line 52, while its inner, circular edge is marked by the discontinuous line 53. The soldering lug 51 projects from this "disk" as it has not yet been bent, as shown in FIG. 3, during the casting but instead lies in the same plane as the base plate 5. During the casting operation the base plate still is held in the carrier band (not shown) by the soldering lug 51 which has not yet been severed from the plate at the free end thereof and by another web 54 (FIG. 2). This plate having the partly punched contour of the base plate is placed in an injection mold in which subsequently the casing portion 1 and the rotary driver half 3 are cast as a single piece, both members still being joined by the sprue 17. In this method step the base plate 5 itself functions as part of the casting mold. As best shown in FIG. 3, the base plate 5 is covered from both sides by plastic material along its outer edges and, as this plastic shrinks during the curing, it becomes pressed firmly against the base plate, thereby providing the desired sealing along this edge. In similar manner the rotary driver 3 embraces the material of the base plate all around the circular edge 53 and again the shrinking of the material upon solidifying, on the one hand, provides the desired contact pressure for the sealing. On the other hand, the torque for rotating the driver 3 with respect to the base plate 5 can be adjusted precisely due to this contact pressure. What is decisive is the shrinking behavior of the plastic which lies in the order of from 0.2 to 0.8%, depending on the plastic material employed.

The casing portion 1 has a basic body 10 substantially of the shape of a cylindrical shell having a radially inwardly protruding abutment nose 11 from which the casting sprue 17 to be broken off or removed later on extends toward the rotary driver half 3. In the embodiment shown, and approximately rectangular extension is contiguous to one side of the basic body 10. It is formed with apertures 13 into which rams protrude during the casting in order to hold the base plate. At the side opposite the abutment nose 11 the basic body 10 is formed with a recess 14 which is set back radially outwardly and provided substantially for reasons of the casting technique. With the exception of the abutment nose 11, the sprue 17 and the recess 14, therefore, the edge 18 of the basic body 10 directed toward the center is circular.

The rotary driver half 3 is spaced from this edge 18 and it in turn includes an abutment nose 31 which projects radially outwardly and may come to rest at the respective side of the abutment nose 11 when the rotary driver half is turned about the axis of rotation 30. The rotary driver 3 is formed at its side facing in upward direction (FIG. 3) or to the interior 9 (FIG. 1) with a disk-like projection 32 which, however, (cf. FIG. 4) does not extend all around for a full circle so that a sufficiently wide section is left where the base plate 5 is accessible from the interior 9. This disk-like projection 32 serves as support for the slider spring 8, while the cut-out section permits the spring lobes 80 to contact the surface of the base plate 5.

The rotary driver half 3 is formed with a central through-hole 33 which includes a radial enlargement in its inwardly directed portion formed with an internal toothing 34. The central narrower portion of the throughhole 33 is formed with projections 35 which act as rotary stops or drivers for an actuating shaft of the potentiometer.

The disk-like projection 32 has webs 36 directed axially upwardly, in other words toward the interior 9. They project from the cylindrical central part of the rotary driver 3 and serve as centering pins for the slider spring 8 (cf. FIG. 4).

The surface of casing portion 1 oriented toward the interior (upwardly in FIG. 3) includes a circumferential, continuous thickening 15 (FIGS. 3 and 4) of triangular cross section and, therefore, ending in a sharp tip which is especially favorable for absorbing ultrasonic energy.

Figure 6:
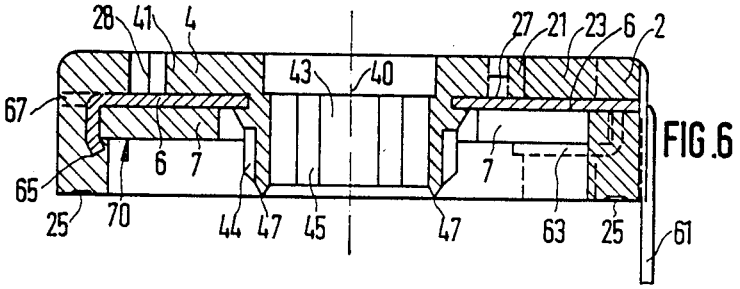
FIG. 6 is a sectional view along line B—B in FIG. 5, in other words of the cover half of the potentiometer.

Adjacent the internal toothing 34 the through-hole 33 formed in the rotary driver half 3 includes a planar circular ring-shaped surface 37 (FIG. 3) which serves as welding surface for the tapering thickening 47 of the other rotary driver member 4 (FIG. 6).

In the area of the recesses 13, finally, the casing portion 1 has centering pins 16 (FIG. 3 and 4) facing upwardly (FIG. 3) and extending into the interior 9. These centering pins later on project into the recesses 23 (FIGS. 5 to 7).

When the plastic material has been cast, the slider spring 8 is inserted and clamped on the centering pin 36 and/or caulked so as to be connected non-rotatably to the rotary driver half 3.

Figure 5:
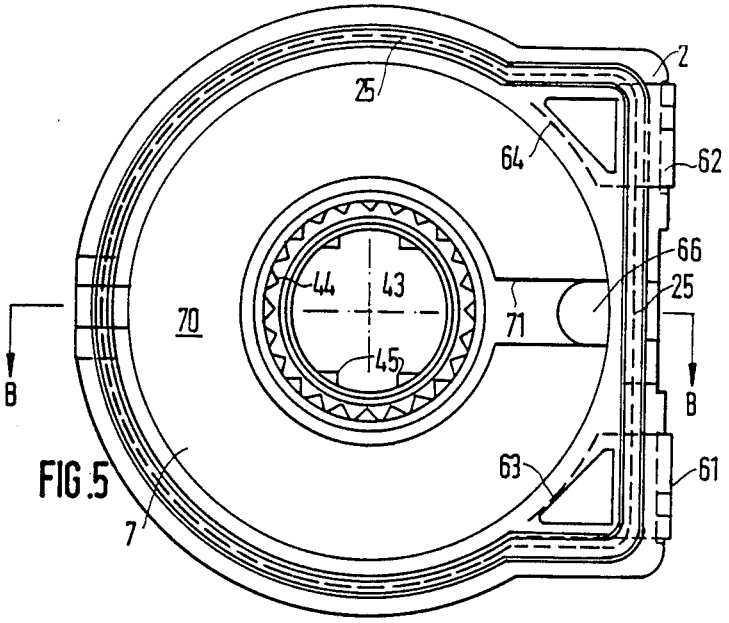
FIG. 5 is a top plan view of the lower inner side of the cover portion of the potentiometer.
Figure 7:
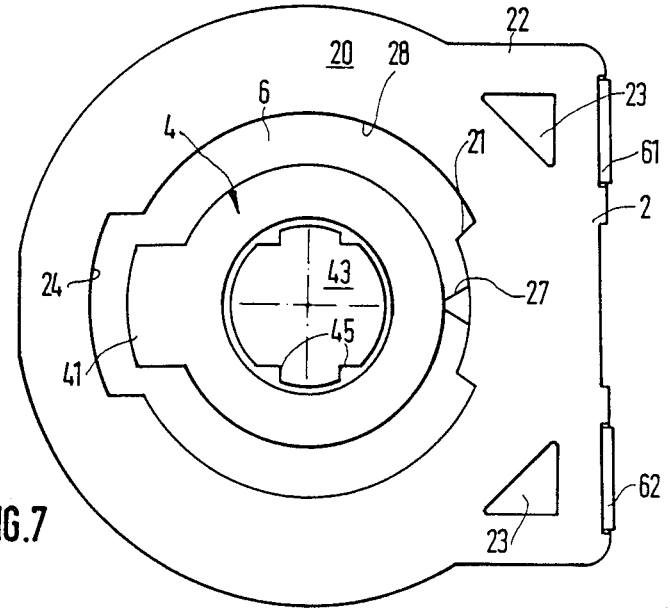
FIG. 7 is a top plan view of the upper outer side of the cover half of the potentiometer.

Reference will now be made to FIGS. 5 to 7. Here, too, the base plate is punched in the desired manner, still being held in a plate by a total of three webs. Two of these webs are formed by the soldering lugs 61 and 62, whereas the third web 67 later on is totally severed. Prior to the casting, the disk-like resistor plate 7 which, however, does not extend through a full circle but instead includes a slot-like cut-out 71 is slipped between the base plate and the contact tabs so that both contact tabs 63 and 64 will touch the resistor path 70 at the side of the resistor plate 7 facing the interior 9. For retaining the resistor plate 7, moreover, a limiting web 65 of the base plate is bent (at the left in FIG. 6) so that the resistor plate on the whole will be held on the base plate 6 by three tabs. In a manner similar to the example of FIGS. 2 to 4, subsequently the casing portion 2 and the rotary driver half 4 are cast in one piece, both these members being joined by the sprue 27 (FIG. 6). As best shown in FIG. 6, the plastic material embraces the base plate 6 as well as the tabs 63, 64, and 65, thereby providing the necessary contact pressure to establish perfect ceiling. This contact pressure also presses contact tabs 63 and 64 against the resistor plate 7 or the resistor layer thereof so that sufficient contact pressure for a low-ohmic contact resistance is obtained. In a manner similar to the rotary driver half 3 in the case of FIGS. 2 to 4 here, too, the other rotary driver half 4 is injection molded to the base plate 6, the rotary driver half 4 overlapping the base plate 6 at both sides around the central circular opening. The substantially cylindrical part of the rotary driver 4 extending in downward direction in FIG. 6 is formed with an external toothing 44 which later on engages the internal toothing 34 of the rotary driver 3. The axially inner end of the rotary driver terminates in the circumferential pointed thickening 47 which later on comes to lie against the surface 37 of the rotary driver 3 (FIG. 3) where it is welded by ultrasound.

The rotary driver 4 has a through-hole 43 which is concentrical with its axis of rotation 40 and formed with radially inwardly protruding projections 45 which act as drivers for the rotary shaft (cf. the projections 35). Also the rotary driver 4 has a radially outwardly projecting abutment nose 41 (cf. the abutment nose 31 of the rotary driver 3) and casing portion 20 also has an abutment 21 corresponding to the abutment 11. The edge 28 likewise corresponds to the edge 18 and the recess 24 to the recess 14.

When both assembly groups according to FIGS. 2 to 4 and 5 to 7, respectively, have been finished and the slider spring 8 has been inserted, the two assembly groups are placed on top of each other and the toothings 34, 44 of the rotary drivers are plugged into each other. Thereupon the ultrasonic welding takes place.

The potentiometer preferably is made from a band in a multiple production process, i.e. at first the contours for the base plates 5 and 6 are punched from a carrier band or a greater plate, the base plates still being joined to the carrier band by webs. Thereupon individual sections (cf. FIG. 6) are bent out of the plane, and the resistor path is slipped in (the resistor plates in the case of a multiple production process). This is followed by the injection molding in the multiple production process. Following the hardening of the plastic material the slider springs are pressed on the respective housing portions and retained and centered on the same by lugs. This is followed by the punching of the soldering lugs and the severing of the connecting webs whereupon the central soldering lug 51 is bent at an angle. Thereupon the one potentiometer half is pressed down through the carrier band and then the potentiometer half which has been pressed through the band is displaced and positioned such that the respective associated parts lie on top of each other. These parts then are pressed into each other and welded together.

Thus it can be seen that the manufacture of this potentiometer can be carried out fully automatically.

What is claimed is:

1. A potentiometer, comprising a casing, a over for the casing, a resistor plate, a rotary driver, and a slider spring non-rotatably fixed to said driver and in sliding contact with a resistor path formed on the resistor plate, the casing, the cover, and the rotary driver being made of plastics, said potentiometer comprising (a) the rotary driver being made of two rotary driver halves, (b) the one rotary driver half together with the cover being formed integrally with at least one of a first base plate and the resistor plate by a plastics injection molding process, (c) the other rotary driver half together with the casing being formed integrally with a second base plate by a plastics injection molding process, and (d) the two rotary driver halves being welded together and the casing and the cover being welded together.

2. The potentiometer as claimed in claim 1, comprising two parallel, spaced apart base plates, with the resistor plate fixed to the one base plate, the slider spring including at least two spring lobes one of which contacts with the resistor path and the other one with the base plate disposed opposite the resistor plate.

3. The potentiometer as claimed in claim 2, the casing being formed with a circumferential thickening of triangular cross section at its side facing the cover and the cover being formed, opposite said thickening, with a groove having a flat bottom, the volume of the groove corresponding approximately to that of the thickening.

4. The potentiometer as claimed in claim 3, is the one rotary driver half being formed at its end facing the other rotary driver half with a circumferential thickening of triangular cross section and the other rotary driver half having planar surface located opposite said thickening.

5. The potentiometer as claimed in claim 1, the two rotary driver halves being partially plugged into each other and each being formed in this area with teeth.

6. The potentiometer as claimed in claim 1, the resistor plate being retained on the base plate by contact tabs joined integrally with the base plate and the contact tabs being surrounded in part by the plastic material of the cover.

7. The potentiometer as claimed in claim 4, the thickening of the one rotary driver half being arranged directly adjacent an axially extending through-hole.

8. The potentiometer as claimed in claim 1, the casing and the one rotary driver half and the cover and the other rotary driver half each being formed integrally with the associated base plate by a plastics injection molding process and each being joined together by a sprue having a rated rupture point.

9. The potentiometer as claimed in claim 8, the base plates including soldering lugs which project out of the casing and cover, respectively.

10. A method of making a potentiometer, as claimed in any one of the preceding claims, comprising the following steps:

(a) a severing carrier band, which is electrically conductive or provided with an electrically conductive coating, in a multiple punch operation in correspondence with the configuration of base plates, the base plates still being connected to the carrier band by webs, (b) bending up tabs at the base plate, (c) slipping a resistor plate between the tabs and the base plate, (d) securing the resistor plate against falling out by prestamping a limiting web at the one base plate, (e) introducing the carrier band with the resistor plates into an injection mold, the carrier band itself functioning as part of the mold, one rotary driver half and one casing half being injection molded in the area of one base plate each, (f) pressing a slider spring on one rotary driver half, (g) punching the webs which retain the base plates in the carrier band thus forming soldering lugs and cutting off connecting webs, (h) Welding two pairs of potentiometer halves together, after being placed on top of each other, by ultrasound.

* * * * *